US009493285B2

(12) United States Patent
Krumme

(10) Patent No.: US 9,493,285 B2
(45) Date of Patent: Nov. 15, 2016

(54) STACKABLE BAG PACKAGING

(71) Applicant: Markus Krumme, Allschwil (CH)

(72) Inventor: Markus Krumme, Allschwil (CH)

(73) Assignee: LTS LOHMANN THERAPIE-SYSTEME AG, Andernach (DE)

( * ) Notice: Subject to any disclaimer, the term of this patent is extended or adjusted under 35 U.S.C. 154(b) by 0 days.

(21) Appl. No.: 14/469,945

(22) Filed: Aug. 27, 2014

(65) Prior Publication Data

US 2014/0363103 A1 Dec. 11, 2014

Related U.S. Application Data

(63) Continuation-in-part of application No. PCT/EP2013/000586, filed on Feb. 28, 2013.

(30) Foreign Application Priority Data

Feb. 29, 2012 (EP) ..... 12001335

(51) Int. Cl.

| | |
|---|---|
| ***B65D 81/24*** | (2006.01) |
| ***B65D 75/56*** | (2006.01) |
| ***B65D 75/58*** | (2006.01) |
| ***B65D 30/00*** | (2006.01) |

(52) U.S. Cl.

CPC ..... *B65D 81/24* (2013.01); *B65D 31/00* (2013.01); *B65D 75/566* (2013.01); *B65D 75/5805* (2013.01); *B65D 75/5833* (2013.01); *B31B 2201/145* (2013.01); *B31B 2217/0084* (2013.01); *B31B 2217/066* (2013.01); *B31B 2217/082* (2013.01)

(58) Field of Classification Search

CPC ..... B65D 75/5816; B65D 75/5805; B65D 75/5833; B65D 2215/04; B65D 81/24; B65D 75/566; B65D 31/00; Y10S 383/906; B31B 2201/145; B31B 2217/0084; B31B 2217/066; B31B 2217/082

USPC ..... 383/200, 207–209; 428/43, 136

See application file for complete search history.

(56) References Cited

U.S. PATENT DOCUMENTS

| | | | | |
|---|---|---|---|---|
| 2,499,528 A * | 3/1950 | Reitzes | ..... | B65D 75/5816 383/106 |
| 2,967,010 A * | 1/1961 | Cuffey, Jr. | ..... | B65D 5/54 206/449 |
| 3,388,836 A * | 6/1968 | Otto | ..... | B65D 75/5805 222/107 |

(Continued)

FOREIGN PATENT DOCUMENTS

WO WO 2011/135050 A1 3/2011

*Primary Examiner* — Peter Helvey
(74) *Attorney, Agent, or Firm* — R. S. Lombard; K. Bach

(57) ABSTRACT

A method for producing a tightly sealed bag packaging and to a tightly sealed bag packaging having at least one perforation and a receiving area surrounded by a plate-shaped edge region for the inert packaging of a product containing active ingredients, wherein the bag packaging comprises cover films or cover film segments bounding the receiving area and forming the edge region. The cover films or cover film segments are each provided with a channel system having at least one channel. The channel system crosses the part of the cover film or the cover film segment covering the receiving area. At one end, each channel is provided with a branching into two channel branches, Furthermore, a slit is arranged between the two channel branches, interrupting a peripheral edge of the bag packaging.

15 Claims, 2 Drawing Sheets

(56) References Cited

U.S. PATENT DOCUMENTS 3,397,835 A * 8/1968 Henning ..... B65D 75/5816 383/200
3,480,198 A * 11/1969 Repko ..... B65D 75/5805 383/203
3,535,409 A * 10/1970 Rohde ..... B29C 37/0057 264/171.28
3,741,778 A * 6/1973 Rowe ..... B65D 81/3492 383/122
3,809,220 A * 5/1974 Arcudi ..... B65D 75/5888 206/484
4,982,845 A * 1/1991 Prascak ..... B65D 75/5827 206/812
5,169,696 A * 12/1992 Lang ..... B32B 27/32 222/107
5,222,813 A * 6/1993 Kopp ..... B65D 75/5805 229/87.05
5,248,040 A * 9/1993 DeMatteis ..... B65D 33/001 206/554
5,470,419 A * 11/1995 Sasaki ..... B29C 47/0021 156/244.12
5,511,664 A * 4/1996 Aramaki ..... B65D 75/5833 206/387.1
5,552,202 A * 9/1996 May ..... B65D 33/2533 383/204
5,558,438 A * 9/1996 Warr ..... B65D 75/5816 383/10
5,593,229 A * 1/1997 Warr ..... B65D 33/08 383/10
5,899,333 A * 5/1999 Williams ..... B65D 75/32 206/469
5,934,809 A * 8/1999 Marbler ..... B65D 75/585 229/87.05
6,340,088 B1 * 1/2002 Mouri ..... B65D 75/566 206/720
6,342,258 B1 * 1/2002 Berings ..... B65D 81/3415 206/5
6,352,365 B1 * 3/2002 Healy ..... B65D 33/01 383/100
6,360,916 B1 * 3/2002 Sokolsky ..... B65D 75/5822 222/107
6,402,379 B1 * 6/2002 Albright ..... B65D 75/5816 383/209
6,679,629 B1 * 1/2004 Benito-Navazo ..... B65D 33/14 206/466
6,702,462 B2 * 3/2004 Richardson ..... B65D 75/566 222/107
7,757,855 B2 * 7/2010 Jarvis ..... B65D 65/40 206/524.1
8,251,217 B2 * 8/2012 Hemmerlin ..... B65D 75/5805 206/532
8,740,458 B2 * 6/2014 Edwards ..... B65B 51/146 383/109
2003/0118254 A1 * 6/2003 Razeti ..... B65D 75/5816 383/204
2005/0276885 A1 * 12/2005 Bennett ..... A23L 1/0128 426/118
2006/0023976 A1 * 2/2006 Alvater ..... B65D 75/5805 383/210
2006/0177162 A1 * 8/2006 Harano ..... B65D 75/5816 383/202
2008/0063324 A1 * 3/2008 Bernard ..... B65D 75/5811 383/200
2008/0105582 A1 * 5/2008 Ludwig ..... B65D 75/30 206/438
2009/0158689 A1 6/2009 Hackbarth
2009/0238502 A1 * 9/2009 Bhattacharjee .... B65D 75/5816 383/208
2010/0326877 A1 12/2010 Hemmerlin et al.
2011/0064338 A1 * 3/2011 Surdziel ..... B65D 75/008 383/207
2011/0293207 A1 * 12/2011 Edwards ..... B65B 51/146 383/201
2012/0048771 A1 3/2012 Reichardt et al.
2013/0251290 A1 * 9/2013 Sterling ..... B65D 75/5816 383/208

* cited by examiner

STACKABLE BAG PACKAGING

CROSS-REFERENCE TO RELATED APPLICATION

This is a continuation-in-part application of pending international application PCT/EP2013/000586 filed Feb. 28, 2013 and claiming the priority of European Patent Application No. 12001335.4 filed Feb. 29, 2012 which is hereby incorporated herein by reference in its entirety as though fully set forth

BACKGROUND OF THE INVENTION

The invention relates to a method for producing a hermetically sealed bag packaging and to a hermetically sealed bag packaging having at least one perforation and having a receiving region which is surrounded by a plate-shaped edge region for the inert packaging of a product containing active substances, wherein the bag packaging includes cover films or cover film portions which define the receiving region and form the edge region.

DE 10 2009 008 027 A1 makes known a bag packaging of this type. The individual closed bag packaging is torn from the stack along a perforation. The bag packaging is then opened by the base film and the cover film being pulled apart from one another at two tabs.

The specific problem underlying the present invention is to develop a stackable hermetically sealed bag packaging which is able to be opened easily and rapidly. In addition, the original presence and configuration of all the individual bag packagings is to be recognizable in the stack.

SUMMARY OF THE INVENTION

Said specific problem is solved with the features of the independent claims. To this end, the cover films or the cover film portions comprise in each case a channel system with at least one channel. The channel system crosses the part of the cover film or of the cover film portion that covers the receiving region. Each channel comprises a branching into two channel branches on one end. In addition, an incision which interrupts a peripheral edge of the bag packaging is arranged between two channel branches.

During production of the hermetically sealed bag packaging, the channel system is introduced into the cover films or cover film portions by means of a laser.

BRIEF DESCRIPTION OF THE DRAWINGS

Further details of the invention are apparent from the dependent claims and from the following drawing figures of exemplary embodiments which are shown schematically.

DETAILED DESCRIPTION OF THE PARTICULAR EMBODIMENTS

Figure 1:
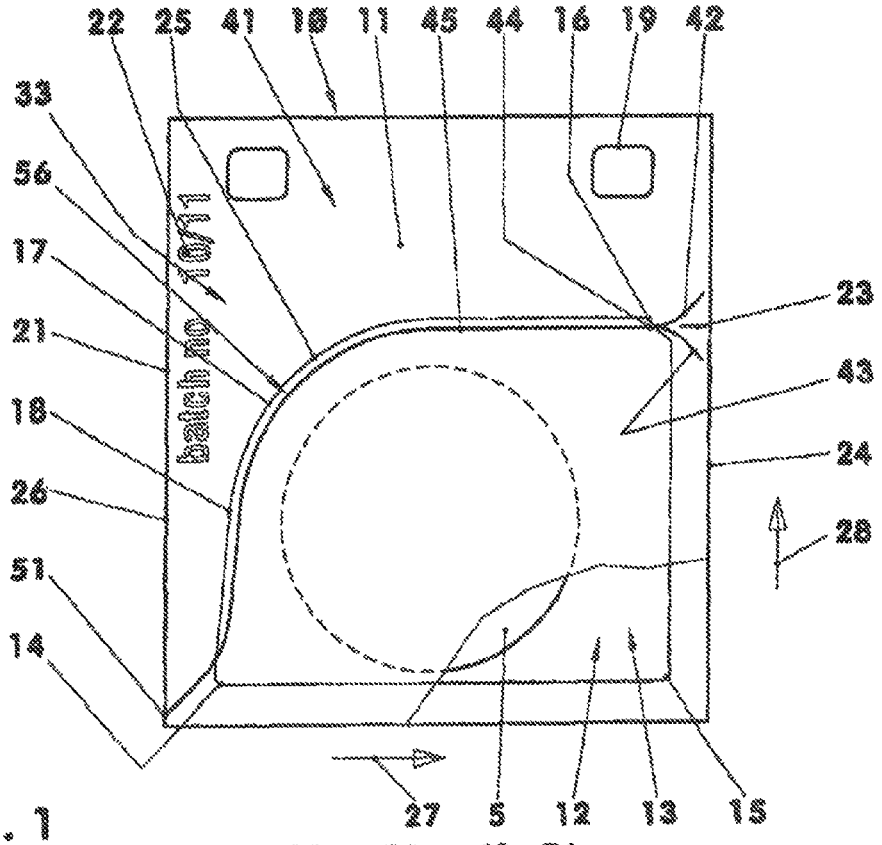
FIG. 1: Top view of the bag packaging.
Figure 2:
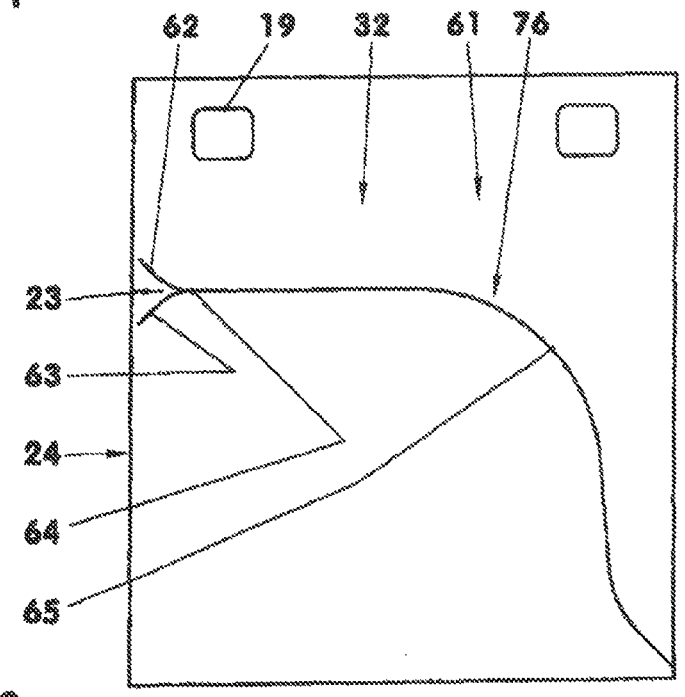
FIG. 2: Rear view of the bag packaging.
Figure 3:
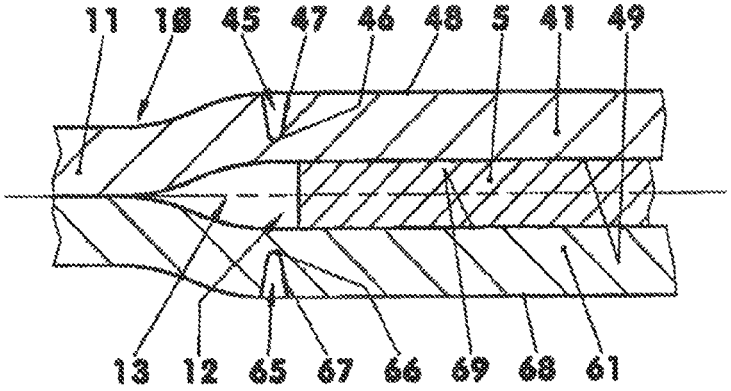
FIG. 3: Part cross section of the bag packaging.

FIGS. 1 to 3 show a bag packaging (10) for a product (5) which contains active substances. These types of bag packagings (10) are provided in stacks, each individual bag packaging (10) including a dose of the product (5) which contains active substances. If, for example, one dose of the product (5) containing active substances has to be taken per day, a stack includes, for example, seven bag packagings (10) for the requirements of one week.

The individual bag packagings (10) of a stack are, for example, identical to one another. In the top view in FIG. 1 the bag packaging (10) has a rectangular area. The length, for example, is 15% longer than the width. Areas that are oval, round, polygonal, etc. are also conceivable.

In the exemplary embodiment, the bag packaging (10) consists of two cover films (41, 61) which are bonded or welded to one another in a peripheral edge region (11). The individual cover film (41; 61), for example, is constructed with multiple layers as a laminate and has an internal metal layer, e.g. an aluminum layer, with a thickness that is greater than 9 micrometers, for example the thickness is between 12 and 25 micrometers. The bag packaging (10) is consequently hermetically sealed. The cover films (41, 61) can be produced from different materials and can have different strength values. The one of said films which are designated here as cover films (41, 61) can be realized as a base film (41, 61). It is also possible for one cover film (41, 61), for example, to be transparent and the other one to be non-transparent. The bag packaging (10) can also be produced from one single folded cover film (41; 61), the two cover film portions of which are then connected together.

The edge region (11) is realized, for example, in a plate-shaped manner. Its minimum width, in the exemplary embodiment, is 10% of the width of the bag packaging (10). It surrounds a receiving region (12). The surface of the receiving region (12) which is projected onto the drawing plane of FIG. 1 is 46% of the projected area of the bag packaging (10). The projected surface of the receiving region (12) is consequently between 40% and 60% of the projected area of the bag packaging (10).

In the representation in FIGS. 1 and 3, the product (5) containing the active substances is arranged inertly in the receiving region (12) which is closed so as to be air-tight and moisture-tight. The surface of the product (5) containing the active substances which is projected onto the drawing plane of FIG. 1 is smaller than the surface of the receiving region (12) which is projected onto said plane. The receiving region (12) consequently includes a strip (13) which surrounds the product (5) containing the active substances.

The receiving region (12), in the representation in FIG. 1, is at least approximately in the form of a rectangle with rounded corners. The lower roundings (14, 15) in said representation have, for example, the same radius. The right-hand upper rounding (16) is oriented in the direction of the receiving region (12). The left-hand upper rounding (17), for example, has a radius which corresponds to a quarter of the width of the bag packaging (10). The boundary (18), which connects said rounding (17) to the left-hand lower rounding (14), encloses, for example, an angle of 5 degrees with the outside edge (26) of the bag packaging. Said angle, for example, can be between two degrees and 30 degrees, the width of the edge region in the representation in FIG. 1 increasing from bottom to top.

Two perforations (19) are arranged in the edge region (11)—remote from the receiving region (12) and at a spacing from said receiving region. The bag packaging (10) is fastened in a non-releasable manner in the stack, for example by means of rivets which penetrate said perforations.

In the representation of FIG. 1, the bag packaging (10) bears a marking (22) outside the receiving region (12) on one of the longitudinal sides (21). For example, the dose number, a serial number or another identification number can be, for example, inscribed here.

The edge region (11) has an incision (23) a few millimeters below the upper end of the receiving region (12) in the exemplary embodiment of FIG. 1. The length of the incision (23) is, for example, 60% of the edge width in said region. In said representation, two channel branches (42, 43; 62, 63) are arranged in a symmetrical manner with respect to the incision (23) in each of the cover films (41, 61) or cover film portions. These are channel-shaped, non-interrupted recesses of the cover films (41, 61) or cover film portions. In the exemplary embodiment, they have a constant, for example U-shaped cross section. All the channel branches (42, 43; 62, 63) are at a spacing of, for example, a millimeter from the longitudinal edge (24) of the bag packaging (10) on the side of the incision.

The two channel branches (42, 43; 62, 63) of a cover film (41; 61) or of a cover film portion are joined in one branch (44; 64) which, in the exemplary embodiment, is arranged at the transition between the rounding (16) and the receiving region (12). The two channel branches (42, 43; 62, 63) merge here tangentially into one channel (45; 65). The respective channel (45; 65) has, for example, the identical cross section as the channel branches (42, 43; 62, 63). In the representation in FIG. 3, the individual channel (45, 65) has a U-shaped channel bottom (46, 66) and walls (47, 67) which open from inside to outside. In said exemplary embodiment, the channel system (56) of the cover film (41) and the channel system (76) of the cover film (61) in each case include a channel (45; 65).

The individual channel (45; 65), in the exemplary embodiment, extends in the direction of the product (5) containing the active substances parallel with and offset to the edge (25) of the receiving region (12). It is at a spacing of, for example, a millimeter from the latter. It consequently crosses the part of the cover film (41; 61) or of the cover film portion that covers the receiving region (12). In the case of the bag packaging (10) with a product (5) containing active substances which is shown in FIGS. 1-3, the channels (45, 65) are arranged, for example, in the outside surfaces (48, 68) of the cover films (41; 61) in the region in which the inside surfaces (49, 69) cover the strip (13).

The channel (45, 65) extends along the edge (25) of the receiving region (12) up to the lower rounding (14). It consequently covers a segment of the receiving region (12) of 90 degrees. The segment passed through by the channel (45; 65) can have an opening angle of between 75 degrees and 90 degrees. The chord of the channel (45; 65) in the receiving region (12) is longer than the largest dimension of the product (5) containing the active substances. The radius of the curved portion of the channel (45; 65) is, for example, 20 millimeters. Said radius is, for example, greater than 10 millimeters. The curve of the channel (45; 65) covers, for example, a sector of, for example, 85 degrees. The sector angle can be between 85-90 degrees. The channel (45; 65) in the representation in FIG. 1 extends from the lower rounding (14) to the right to the left-hand outside edge (26), which it contacts at the end point (51). The individual channel (45; 65) can, however, also terminate in the edge region (11) between the receiving region (12) and the longitudinal edge (26).

If the channel (45) is projected onto a plane coordinate system which is arranged in the drawing plane in FIG. 1, the cross direction (27) being the abscissa and the longitudinal direction (28) being the ordinate, the development in the region between the end point (51) and the branching (44) produces a monotone curve which is continuously differentiable. Each value in the cross direction (27) has associated therewith precisely one value in the longitudinal direction (28) of the bag packaging (10).

In the exemplary embodiment, the channels (45, 65) of the two cover films (41, 61) or of the two cover film portions are congruent with respect to one another. The depth of the individual channel (45, 65) corresponds to a maximum of 90% of the thickness of the cover film (41, 61) or of the cover film portion. The individual channel (45, 65) can also have a rectangular, V-shaped, etc. cross section instead of the described cross section.

The channels (45, 65) are introduced into the cover films (41, 61), for example, during production of the bag packaging (10). This is effected, for example, by means of a so-called laser scoring. In this connection, individual regions of the surface of the cover film (41, 61) are removed by means of a laser. Removal is effected along a line as a result of the relative movement between the cover film (41, 61) and the laser with respect to one another. In this connection, the metal layer of the cover film (41, 61) can be weakened, said metal layer, however, remains closed. For example, the channel system (56, 76) is introduced up to a depth of 90% of the metal layer. The channel (45; 65) neither penetrates the metal layer, nor is the metal layer perforated. Consequently, the tightness of the individual bag packaging (10) is ensured. Once the first channel (45; 65) including a channel branch (42; 43; 62; 63) has been produced, the second channel branch (43; 42; 63; 62), for example, is introduced from the branching (44; 64). The marking (22) is generated parallel to this, for example.

The introducing of the channel system (56, 76) can be effected prior to or after the producing of the bag packaging (10) and the introducing of the product (5) containing active substances.

If the channel system (56, 76) is introduced into the individual cover films (41, 61), for example prior to the welding process, the cover films (41, 61), including the product (5) containing the active substances, are laid one on top of another and are connected together so as to be aroma-tight. Said connection is effected, for example, over the entire area in the edge region (11) of the bag packaging (10).

The finished bag packaging (10) is stacked and riveted. It can then be provided to the user in the stack, for example in a so-called calendar pack. Each individual dose is packaged in a hermetically sealed and insert manner. The individual dose is consequently protected from the environment in a gas-tight, aroma-tight and moisture-tight manner.

Figure 4:
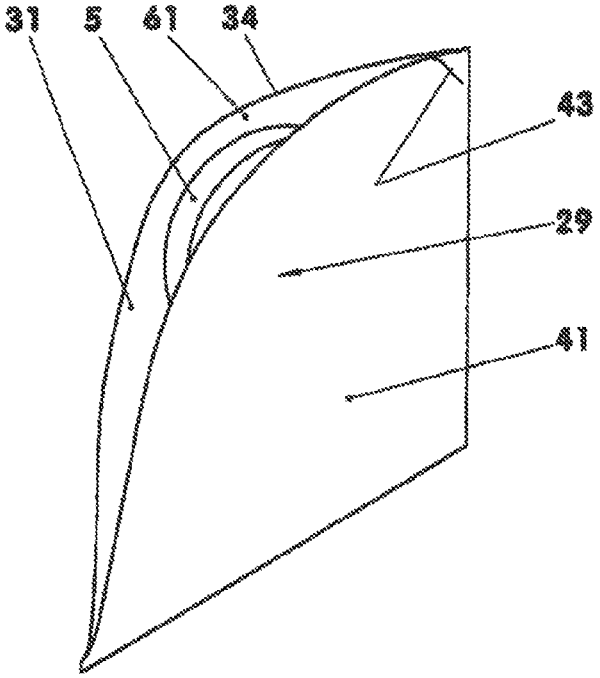
FIG. 4: Pouch-shaped part of the bag packaging.

For removal, the user holds the stack, for example with his left hand, and grips the bag packaging (10), for example with two fingers on the right hand. In this connection, the thumb lies, for example, on the receiving region (12) and the forefinger supports the rear side of the receiving region (12). If the right hand is then moved to the left, the bag packaging tears at the incision (23). The tear continues—increasing the resistance—along both cover films (41, 61), for example up to the branchings (44, 64). If the tear from the incision is not in a straight line, but continues in an inclined manner, it catches along the upper channel branches (42, 62) or the lower channel branches (43, 63). There the tear is guided into the channel branches (42, 43; 62, 63). The tear continues in both cover films (41; 61) in the direction of the branchings (44, 64) along the channel branches (42, 34; 62, 63) which comprise a lesser material strength than the surrounding cover film (41, 61). When torn further, the tear follows the channels (45, 65) at least from the branchings (44, 64). When the right hand is moved further to the left, cf. FIG. 1, an increasing tear growth to the left is effected. As a result of the described geometry of the channel (45, 65), the opening of the bag packaging (10) can be effected in one single pull. As the development of the channel (45; 65) along the entire channel length has a component in the cross direction (27) which is greater than zero in each increment, the tearing open is not obstructed or blocked. The user does not need to change his direction of pulling. The receiving region (12) is opened outside of the product (5) containing the active substances. At the same time, a pouch-shaped part (29) with the product (5) containing the active substances is torn off, cf. FIG. 4. The product (5) containing the active substances, in this connection, remains in the pouch-shaped part (29) of the bag packaging (10) which the user holds in his hand with the opening (31) upward. As a result of the large opening (31) of the pouch (29) the product (5) containing the active substances can be removed without any difficulties.

The opening operation described here is suitable for right-handed people who pull with the right hand. However, the same bag packaging (10) can also be used for left-handed people. For this purpose, the rear side (32) is directed upward, cf. FIG. 2. The opening operation is effected analogously to as described above. One single hand movement is enough to open the bag packaging (10) in this case also.

Once the pouch (29) with the product (5) containing the active substances has been torn off, the, for example, upper and left-hand edge region (33) of the bag packaging (10) remains in the stack. The marking (22) is in said part (33) of the edge region (11). Consequently, the user or a third party can easily check whether, for example, the dose of the product (5) containing the active substances provided for the day has already been removed. In addition, even after a bag packaging (10) has been removed, the original position and the configuration of all the individual bag packagings (10) can be recognized in a perfect manner. Even if all the bag packagings (10) have already been removed from the stack, proof of the original arrangement of the individual doses in the calendar pack is possible in this way.

The channels (45, 65) and the channel branches (42, 4; 62, 63) can also be introduced into the cover films (45, 65) or into the cover film portions in a manner other than the described method, for example, etching, engraving, etc.

The channels (45, 65) of the two cover films (42, 43, 62, 63) or cover film portions can also be arranged in regions offset with respect to one another. An inclined tear along the bag packaging (10) is then produced, for example. The tear edge (34) produced can be arranged, for example, such that the cover film (41, 61) that faces the user is cut in deeper than the cover film (61; 41) that is remote from the user.

The channels (45, 65) and/or the channel branches (42, 43; 62, 63) can also be arranged on the inside surfaces (49, 69) of the cover films (41, 61) or the cover film portions. It is also conceivable to insert the channels (45; 65) of one cover film (41; 61) in the inside surface (49) and the channel (65; 45) of the other cover film (61; 41) in the outside surface (48; 68). One or both channel branches (42, 43; 62, 63) can also be introduced in a surface (48; 49) other than the channel (45; 65).

Figure 5:
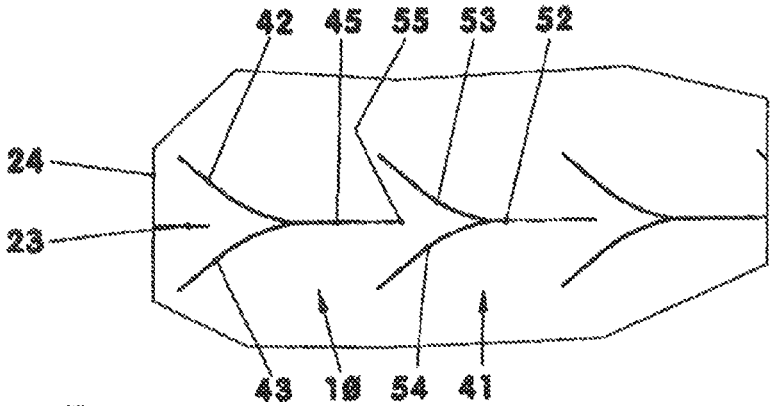
FIG. 5: Channel system with several channels.

In the exemplary embodiment, the channel (45, 65) is realized in a linear manner. However, the channel (45, 65) can also have a wave shape, it can have secondary channels, etc. The bag packaging (10) can also include channel systems (56, 76) with several channels (45, 52, 65), cf. FIG. 5. In said FIG. 5, a bag packaging (10) is shown, for example, which is torn open from left to right. The individual channel (45, 65) terminates in the cover film (41, 61). A connecting channel (52) then has two channel branches (53, 54) which lie on both sides of the channel end (55) of the first channel (45). Short zones of increased resistance are produced—proceeding from the incision (23)—when it is torn open with one hand. As a result, inadvertent tearing, for example, of the bag packaging (10) can be made difficult.

Obviously, it is also conceivable to combine the different named embodiments together.

LIST OF REFERENCES

5 Product containing active substances
10 Bag packaging
11 Edge region
12 Receiving region
13 Strip
14 Lower rounding
15 Lower rounding
16 Upper rounding
17 Upper rounding
18 Boundary
19 Perforations
21 Longitudinal sides
22 Marking
23 Incision
24 Longitudinal edge, on the side of the incision, peripheral edge
25 Edge of (12)
26 Outer edge, peripheral edge
27 Cross direction
28 Longitudinal direction
29 Pouch-shaped part, bag
31 Opening
32 Rear side
33 Upper and left edge region, part of (11)
34 Tear edge
41 Cover film, base film
42 Channel branch
43 Channel branch
44 Branching
45 Channel
46 Channel bottom
47 Walls
48 Outside surface
49 Inside surface
51 End point
52 Channel
53 Channel branch
54 Channel branch
55 Channel end
56 Channel system
61 Cover film; base film
62 Channel branch
63 Channel branch
64 Branching
65 Channel
66 Channel bottom
67 Walls
68 Outside surface
69 Inside surface
76 Channel system

What is claimed is:

1. A hermetically sealed bag packaging (10) comprising: at least one perforation (19) and having a receiving region (12) which is surrounded by a plate-shaped edge region (11) in inert packaging arrangement with a product (5)

containing active substances, the receiving region (12) is rectangular and has an edge (25), the receiving region (12) includes a strip (13) which surrounds the product (5) containing active substances, two cover films (41, 61) or a single cover film having two folded cover film portions which define the receiving region (12) and form the plate-shaped edge region (11), the two cover films (41, 61) or the cover film portions comprise in each case a channel system (56, 76) having at least one channel (45; 65), the channel system (56; 76) crosses the part of each of the two cover films (41; 61) or the cover film portion that covers the receiving region (12), the at least one channel (45, 65) extending in the direction of the product (5) containing the active substances parallel with and offset to the edge (25) of the rectangular receiving region (12), each of the at least one channel (45, 65) comprises a branching (44, 64) into two channel branches (42, 43; 62, 63) on one end thereof and an end point (51) on or proximate a peripheral edge (26) at the other end thereof, the at least one channel (45, 65) between the end point (51) and the branching (44, 64) is a monotone curve with the curve covering a sector angle between 85 to 90 degrees and an incision (23) for interrupting a peripheral edge (24) of the bag packaging (10) is operatively arranged between two channel branches (42, 43; 62, 63) in the plate-shaped edge region (11), each of the channel branches (42,43; 62,63) are on the side of the incision (23), the channel branches (42,43; 62,63) are in symmetrical arrangement with respect to the incision (23), the channel branches (42, 43; 62, 63) are at a predetermined spacing from the peripheral edge (24) of the bag packaging (10) proximate the incision (23).

2. The hermetically sealed bag packaging (10) as claimed in claim 1, characterized in that each of the at least one channel (45; 65) is free of interruptions.

3. The hermetically sealed bag packaging (10) as claimed in claim 1, characterized in that the two channel systems (56; 76) are arranged so as to be congruent with respect to one another.

4. The hermetically sealed bag packaging (10) as claimed in claim 1, characterized in that each channel system (56, 76) contacts a maximum of one peripheral edge (26).

5. The hermetically sealed bag packaging (10) as claimed in claim 4, characterized in that the peripheral edge (26) contacted by at least one of the channels (45; 65) is remote from the incision (23).

6. The hermetically sealed bag packaging (10) as claimed in claim 1, characterized in that the channel systems (56, 76) cross the receiving region (12) in a segment, the opening angle of which is between 75 degrees and 90 degrees.

7. The hermetically sealed bag packaging (10) as claimed in claim 1, characterized in that said bag packaging bears a marking (22) in the edge region (11) which bears a perforation (19) outside the at least one channel (45; 65).

8. The hermetically sealed bag packaging (10) as claimed in claim 1, characterized in that the depth of the at least one channel (45; 65) is a maximum of 90% of the thickness of one of the two cover films (41; 61) or of a cover film portion.

9. The hermetically sealed bag packaging (10) as claimed in claim 1, characterized in that the individual channel (45; 65) comprises an extensively U-shaped cross section.

10. The hermetically sealed bag packaging (10) as claimed in claim 1, characterized in that the individual cover film (41; 61) or the individual cover film portion is constructed with several layers with an internal closed metal layer.

11. The bag packaging (10) as claimed in claim 1, characterized in that the receiving region (12) is formed as an approximate rectangle.

12. The bag packaging (10) as claimed in claim 11, characterized in that the at least one channel (45, 65) covers a segment along the edge (25) of the receiving region (12) of 90 degrees.

13. The bag packaging (10) as claimed in claim 1, characterized in that the at least one of the at least one channel (45, 65) and the channel branches (42, 43; 62, 63) are arranged on an inside surface (49, 69) of the cover films (41, 61).

14. The bag packaging (10) as claimed in claim 13, characterized in that the at least one channel (45, 65) of one cover film (41, 61) operatively arranged in an inside surface (49, 69) of the one cover film (41, 61) and the other at least one channel (65, 45) of the other cover film (61, 41) operatively arranged in an outside surface (48, 68) of the other cover film (61, 41).

15. The bag packaging (10) as claimed in claim 1, characterized in that one or both of the channel branches (42, 43; 62, 63) operatively arranged in a surface (48, 49) other than the channel (45, 65).

* * * * *